US010687133B2

(12) United States Patent
Ozawa

(10) Patent No.: US 10,687,133 B2
(45) Date of Patent: Jun. 16, 2020

(54) HEADPHONE

(71) Applicant: Audio-Technica Corporation, Tokyo (JP)

(72) Inventor: Hiromichi Ozawa, Kanagawa (JP)

(73) Assignee: AUDIO-TECHNICA CORPORATION, Tokyo (JP)

( * ) Notice: Subject to any disclaimer, the term of this patent is extended or adjusted under 35 U.S.C. 154(b) by 0 days.

(21) Appl. No.: 15/637,120

(22) Filed: Jun. 29, 2017

(65) Prior Publication Data

US 2018/0103309 A1 Apr. 12, 2018

(30) Foreign Application Priority Data

Oct. 12, 2016 (JP) ..... 2016-200623

(51) Int. Cl.

| | |
|---|---|
| ***H04R 1/10*** | (2006.01) |
| ***H04R 5/033*** | (2006.01) |
| ***H04R 9/02*** | (2006.01) |
| ***H04R 9/06*** | (2006.01) |

(52) U.S. Cl.

CPC ..... *H04R 1/1008* (2013.01); *H04R 1/1075* (2013.01); *H04R 5/033* (2013.01); *H04R 9/025* (2013.01); *H04R 9/06* (2013.01)

(58) Field of Classification Search

CPC ..... H04R 1/1008; H04R 1/1075; H04R 5/033
See application file for complete search history.

(56) References Cited

U.S. PATENT DOCUMENTS

| | | | | |
|---|---|---|---|---|
| 2,989,598 | A * | 6/1961 | Touger | H04R 1/1008 128/867 |
| 3,999,020 | A * | 12/1976 | Bastiaans | H04R 1/1041 381/372 |
| 4,058,688 | A * | 11/1977 | Nishimura | H04R 1/1008 381/372 |
| 5,109,424 | A * | 4/1992 | Andre | H04R 1/1008 381/371 |
| 5,729,605 | A * | 3/1998 | Bobisuthi | H04R 1/1041 379/430 |
| 8,861,766 | B2 * | 10/2014 | Ouryouji | H04R 1/1058 381/370 |
| 9,210,495 | B2 * | 12/2015 | Akino | H04R 1/1008 |
| 9,674,596 | B2 * | 6/2017 | Briggs | H04R 1/1066 |
| 9,693,129 | B2 * | 6/2017 | Kamada | H04R 1/1075 |
| 9,699,541 | B2 * | 7/2017 | Tsubone | H04R 1/1008 |
| 9,800,976 | B2 * | 10/2017 | Honda | H04R 5/033 |

(Continued)

FOREIGN PATENT DOCUMENTS

| | | | |
|---|---|---|---|
| CN | 101257728 | A | 9/2008 |
| CN | 102282864 | A | 12/2011 |

(Continued)

*Primary Examiner* — Fan S Tsang
*Assistant Examiner* — Ryan Robinson
(74) *Attorney, Agent, or Firm* — W&C IP

(57) ABSTRACT

A headphone is provided that includes a driver unit securely fixed to the baffle plate with a simple structure and has desirable frequency characteristics in a high frequency range and a low frequency range. A headphone includes a baffle plate, a driver unit fixed to the baffle plate, and a fixing member fixing the driver unit to the baffle plate. The fixing member includes a contact part having a shape of a plate in contact with the outer edge of the driver unit.

14 Claims, 6 Drawing Sheets

(56) References Cited

U.S. PATENT DOCUMENTS

| | | | | |
|---|---|---|---|---|
| 10,171,905 | B2 * | 1/2019 | Wen | H04R 1/1075 |
| 2009/0010474 | A1 | 1/2009 | Ouryouji | |
| 2016/0142812 | A1 * | 5/2016 | Honda | H04R 5/033 381/372 |
| 2016/0142813 | A1 * | 5/2016 | Honda | H04R 1/1008 381/370 |
| 2018/0109866 | A1 * | 4/2018 | Tsuihiji | H04R 1/1008 |
| 2018/0249237 | A1 * | 8/2018 | Grell | H04R 1/1008 |
| 2019/0104353 | A1 * | 4/2019 | Ishikawa | H04R 1/1058 |

FOREIGN PATENT DOCUMENTS

| | | | |
|---|---|---|---|
| EP | 1179968 | A2 | 2/2002 |
| EP | 2 439 957 | A2 | 4/2012 |
| EP | 2921928 | A1 | 9/2015 |
| JP | 1993-80090 | U | 10/1993 |
| JP | 2003 179990 | A | 6/2003 |
| JP | 2008 211617 | A | 9/2008 |
| JP | 201062888 | A | 3/2010 |
| JP | 2011-87048 | A | 4/2011 |
| JP | 2014-127730 | A | 7/2014 |
| JP | 2016-100647 | A | 5/2016 |

* cited by examiner

HEADPHONE

TECHNICAL FIELD

The present invention relates to a headphone.

BACKGROUND ART

A headphone of an over-ear type, for example, is worn on the head of a user who listens to a musical sound from a sound source such as a music player. The headphone has a pair of sound emission units (ear pieces) and a connection member connecting the sound emission units.

Each sound emission unit includes a driver unit, a baffle plate, an acoustic resistor, and a housing. The driver unit converts electric signals (audio signals) from a sound source, such as a music player, to sound waves and outputs the sound waves. The driver unit includes a diaphragm, a magnetic circuit, and a unit case. The driver unit is of a dynamic type. The unit case is composed of synthetic resin which does not interfere with the magnetism of the magnetic circuit.

The driver unit is held by the baffle plate and accommodated in the housing. The acoustic resistor is disposed in the rear side (the side opposite to the side in which the driver unit outputs sound waves) of the driver unit.

Recently, a typical headphone includes sound emission units rotatable relative to the connection member or foldable toward the connection member so as to allow a compact storage of the headphone into a bag, for example. However, such a typical headphone receives strong shock inside the bag when the bag with the headphone accommodated therein collides with an object. When the headphone receives strong shock, the driver unit may be detached from the baffle plate, and the headphone may be broken down. Thus, the driver unit east be securely fixed to the baffle plate.

Various schemes have been proposed to fix the driver unit to the baffle plate: For example, the driver unit is fixed to the baffle plate with an adhesive (for example, refer to Japanese Unexamined Patent Publication No. 2014-127730); the driver unit is fitted into the peripheral wall provided on the baffle plate (for example, refer to Japanese Unexamined Patent Publication No. 2011-87048); the driver unit is fixed with claw members standing on the baffle plate (for example, refer to Japanese Unexamined Utility Model Application Publication No. 1993-80090); and the driver unit is fixed with a cylindrical fixing member (for example, refer to Japanese Unexamined Patent Publication No. 2016-100647).

SUMMARY OF INVENTION

Technical Problem

The scheme disclosed in Japanese Unexamined Patent Publication No. 2014-127730 involves a difficulty in maintenance of the driver unit, such as the replacement of the driver unit. For a headphone of an open type, an adhesive may be visible from the outside of the headphone, and the design of the headphone may be thereby impaired. Furthermore, the adhesives may be deteriorated over the years, and the frequency characteristics of the driver unit may be thereby affected.

The schemes disclosed in Japanese Unexamined Patent Publication No. 2011-87048, Japanese Unexamined Utility Model Application Publication No. 1993-80090, and Japanese Unexamined Patent Publication No. 2016-100647 enable the replacement of the driver unit and facilitate the maintenance of the headphone. In addition, the headphones assembled by the schemes disclosed in Japanese Unexamined Patent Publication No. 2011-87048, Japanese Unexamined Utility Model Application Publication No. 1993-80090, and Japanese Unexamined Patent Publication No. 2016-100647 are resistant to deterioration over the years and have a good design compared with the headphones assembled by the scheme involving the fixing with an adhesive.

The schemes disclosed in Japanese Unexamined Patent Publication No. 2011-87048, Japanese Unexamined Utility Model Application Publication No. 1993-80090, and Japanese Unexamined Patent Publication No. 2016-100647, however, may complicate the structure of the headphone, and require separate design depending on the dimensions of the driver unit. The schemes disclosed in Japanese Unexamined Patent Publication No. 2011-87048, Japanese Unexamined Utility Model Application Publication No. 1993-80090, and Japanese Unexamined Patent Publication No. 2016-100647, which fix the driver unit to the baffle plate with the fixing member, such as the peripheral wall or the claw members, hereinafter referred to as "fixing member," may also produce a gap between the driver unit and the acoustic resistor disposed in the rear of the driver unit. This gap has an acoustic capacitance and serves as a low pass filter. As a result, the frequency characteristics in a high frequency range deteriorate.

The unit case which is composed of synthetic resin is deformed when the driver unit is fixed to the baffle plate, and a gap may be produced between the driver unit and the fixing member. A gap may also be produced between the driver unit and the baffle plate, depending on the dimensional accuracy of the driver unit and the baffle plate. As a result, the driver unit is not securely fixed to the baffle plate, and the driver unit can be vibrated during output of the sound waves.

An object of the present invention is to solve the problem described above and to provide a headphone that includes a driver unit securely fixed to the baffle plate with a simple structure and has desirable frequency characteristics in a high frequency range and a low frequency range.

Solution to Problem

The headphone according to the present invention includes a baffle plate, a driver unit fixed to the baffle plate, and a fixing member fixing the driver unit to a baffle plate. The fixing member includes a contact part having a shape of a plate in contact with the outer edge of the driver unit.

Advantageous Effects of Invention

According to the present invention, a headphone can be provided that includes a driver unit securely fixed to a baffle plate with a simple structure and has desirable frequency characteristics in a high frequency range and a low frequency range.

DESCRIPTION OF EMBODIMENTS

Embodiments of the headphone according to the present invention will now be described with reference to the accompanying drawings.

Configuration of Headphone

Figure 1:
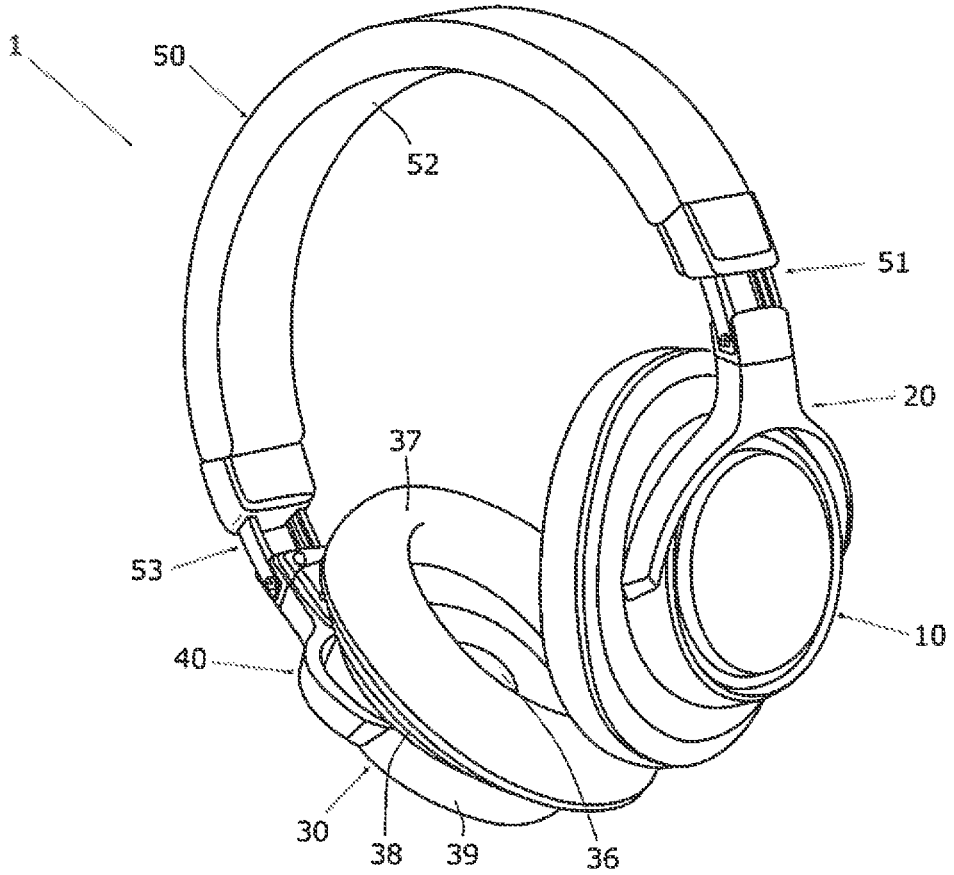
FIG. 1 is a perspective view showing an embodiment of a headphone according to the present invention.

FIG. 1 a perspective view of an embodiment of a headphone according to the present invention.

A headphone 1 is worn on the head of a user, and outputs sound waves in response to sound signals from a sound source (not shown), such as a portable music player, toward the eardrums of the user. The headphone 1 is a wireless headphone that receives sound signals from the sound source via a wireless communication line, for example.

The headphone according to the present invention may be a wired headphone that receives sound signals from the sound source via a cable, for example.

In the description below, the up and down, right and left, and front and rear directions of the headphone 1 respectively correspond the up and down, right and left, and front and rear directions of the user wearing the headphone 1 on the head (hereinafter referred to as "worn state of the headphone"). That is, a left sound emission unit 10 (described below) is worn on the left ear of the user, for example.

The headphone 1 has the left sound emission unit (left ear piece) 10, a left hanger 20, a right sound emission unit (right ear piece) 30, right hanger 40, a connection member 50, and a signal line (not shown).

Figure 2:
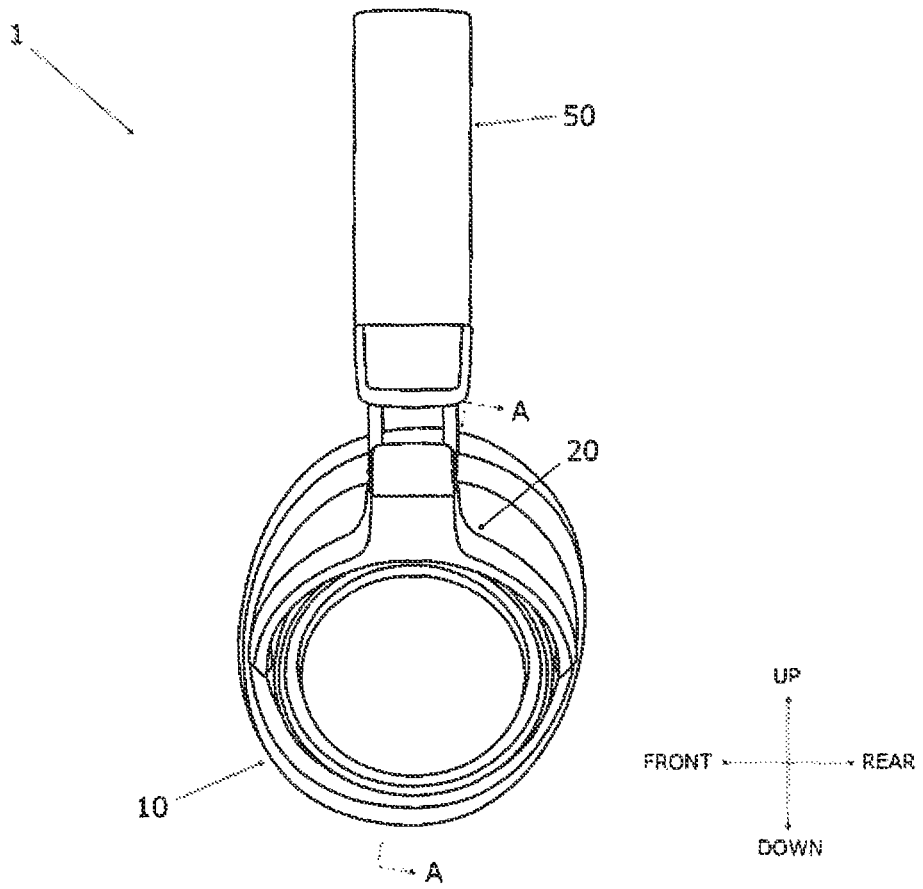
FIG. 2 is a right side view of the headphone in FIG. 1.

FIG. 2 is a side view of the headphone 1.

Figure 3:
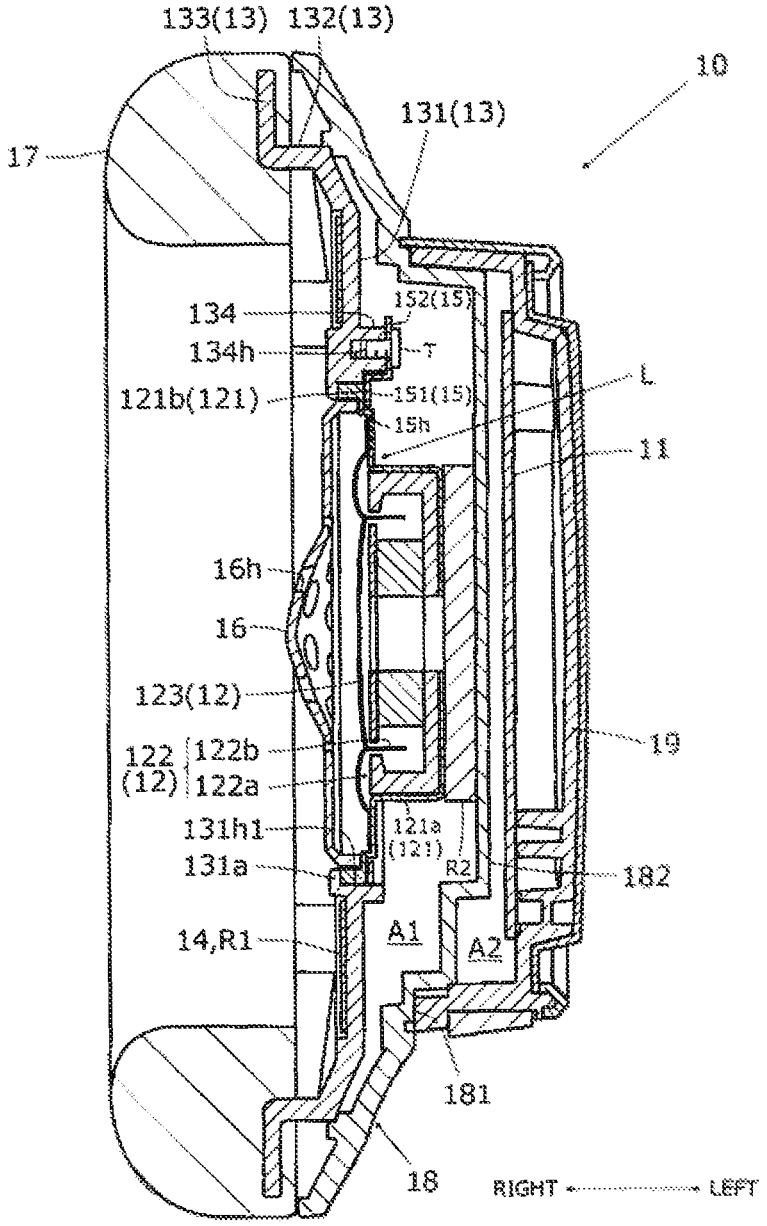
FIG. 3 is a cross-sectional view taken along the line A-A of a left sound emission unit of the headphone in FIG. 2.

FIG. 3 is a cross-sectional view of the left sound emission unit 10 taken along the line A-A in FIG. 2.

The left sound emission unit 10 is worn around the left ear of the user and configured to output sound waves in response to sound signals from the sound source. The left sound emission unit 10 includes a circuit board 11, a left driver unit 12, a left baffle plate 13, a left frame 14, a left unit fixing member 15, a left protector 16, a left ear pad 17, a first left housing 18, a second left housing 19, a first left acoustic resistor R1, a second left acoustic resistor R2, and multiple (three) fixing screws T. The left driver unit 12, the left baffle plate 13, the left frame 14, the left unit fixing member 15, the first left acoustic resistor R1, and the fixing screws T constitute a left assembly L.

The circuit board 11 includes a receiving circuit (not shown) and a signal processing circuit (not shown). The receiving circuit receives sound signals from the sound source via the wireless communication line, for example. The sound signals received by the receiving circuit are digital signals. The signal processing circuit processes the digital sound signals received by the receiving circuit (for example, selecting, extracting, and combining required signals) to transmit the processed sound signals to the left driver unit 12 and a right driver unit (described below). The signals processed at the signal processing circuit (hereinafter referred to as "processed signals") are digital signals generated through a pulse modulation process on sound signals, for example.

For a wired headphone according to the present invention, the receiving circuit includes terminals, such as universal serial bus (USB) terminals or cable terminals, and receives sound signals from the sound source via a cable.

Figure 4:
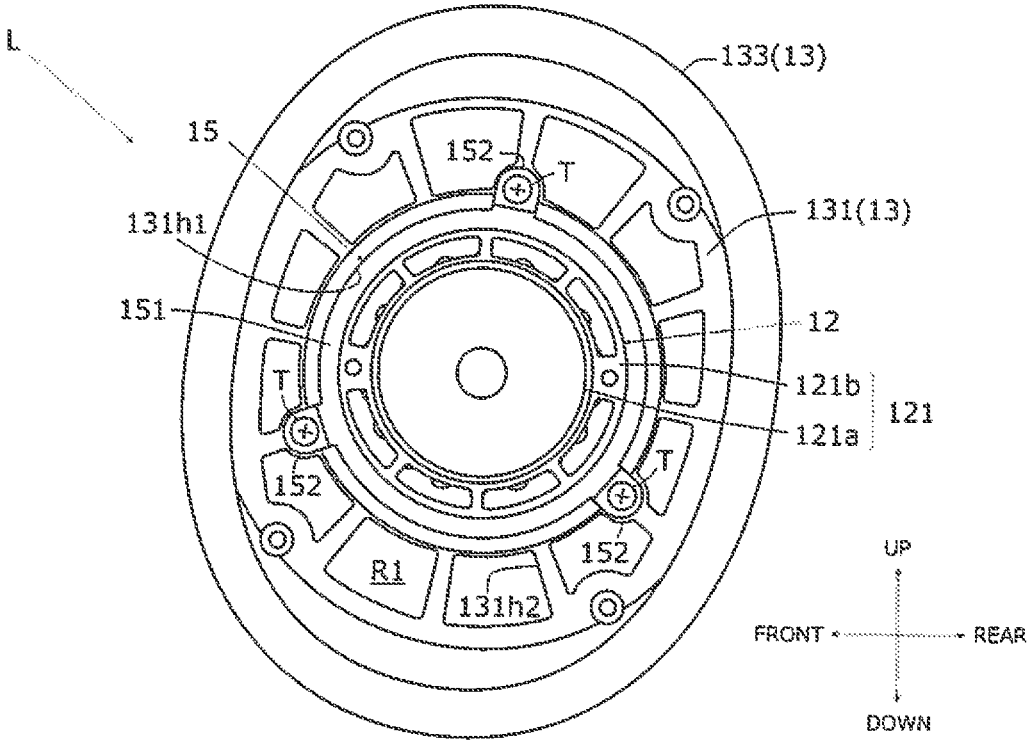
FIG. 4 is a right side view of a left assembly of the headphone in FIG. 1.

FIG. 4 is a right side view of the left assembly L.

Figure 5:
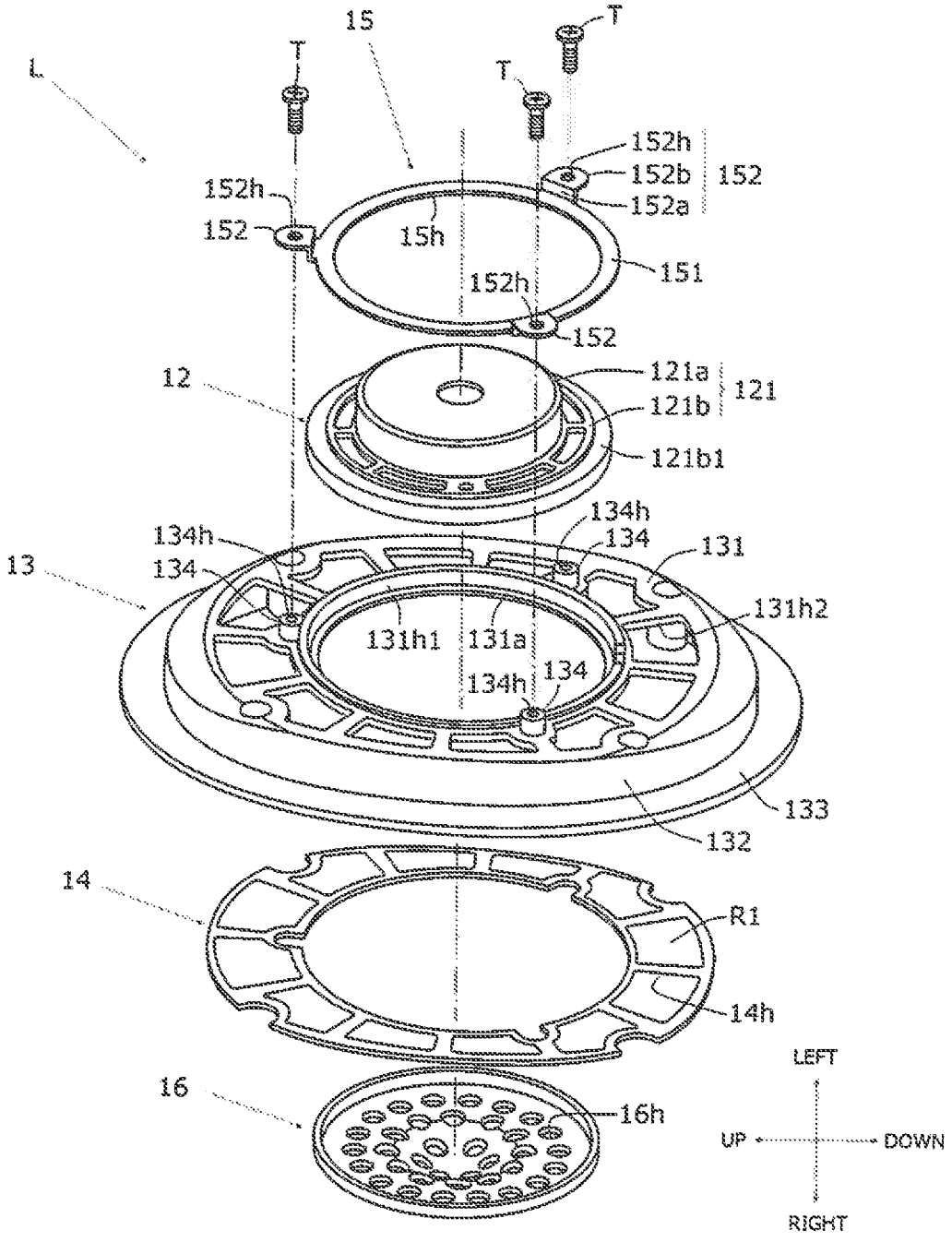
FIG. 5 is an exploded perspective view of the left assembly in FIG. 4.

FIG. 5 is an exploded perspective view of the left assembly L.

The left driver unit 12 converts the processed signals to sound waves to output the sound waves. The left driver unit 12 includes a unit case 121, a driving part 122, and a diaphragm 123, as shown in FIG. 3.

The unit case 121 accommodates the driving part 122 and the diaphragm 123. The unit case 121 is composed of synthetic resin, for example. The unit case 121 has a circular hat shape in the plain view. The unit case 121 includes a body 121*a* and a flange portion 121*b*. The body 121*a* has a shape of a hollow cylinder with an open end and a closed end. The flange portion 121*b* has a shape of a ring. The flange portion 121*b* is disposed on the outer circumferential surface of the open end of the body 121*a*. The flange portion 121*b* is an example of the outer edge of the driver unit in the present invention. The flange portion 121*b* includes a depression 121*b*1. The depression 121*b*1 is disposed at the outer edge portion of the surface of the left side (the upper side in FIG. 5) of the flange portion 121*b*.

The driving part 122 is configured to drive (vibrate) in response to the processed signals and thereby drives (vibrates) the diaphragm 123. As shown in FIG. 3, the driving part 122 includes a magnetic circuit 122*a* and multiple (four, for example) voice coils 122*b*. The magnetic circuit 122*a* includes a magnetic gap, and generates magnetic flux in the magnetic gap. The voice coils 122*b* are configured to drive in response to the processed signals. The processed signals are respectively applied to each of the voice coils 122*b*.

The diaphragm 123 is configured to drive (vibrate) in response to the drive (vibration) of the voice coils 122*b* to generate sound waves. The diaphragm 123 is attached to the flange portion 121*b*. The diaphragm 123 attached to the flange portion 121*b* can vibrate relative to the flange portion 121*b* (and the unit case 121).

The voice coils 122*b* are attached to the diaphragm 123. The voice coils 122*b* are disposed in the magnetic gap so as to traverse the magnetic flux generated in the magnetic circuit 122*a*. The voice coils 122*b* are configured to vibrate relative to the magnetic circuit 122*a* in response to the electromagnetic force generated by the processed signals applied to the voice coils 122*b*.

The number of the voice coils in the headphone according to the present invention is not limited to "four."

The left baffle plate 13 holds the left driver unit 12 and the left ear pad 17. The left baffle plate 13 is composed of synthetic resin, for example. The left baffle plate 13 has a shape of an oval hat in the plain view. The left baffle plate 13 has a bottom portion 131, a peripheral portion 132, flange portion 133, and three bosses 134.

The bottom portion 131 has a shape of an oval ring plate. The peripheral portion 132 has a shape of an oval cylinder. The flange portion 133 has a shape of an oval ring plate. The bottom portion 131 is coupled to the open end on the left side (the upper side in FIG. 5) of the peripheral portion 132. The flange portion 133 is coupled to the outer circumferential surface at the open end on the right side (the lower side in FIG. 5) of the peripheral portion 132.

The bottom portion 131 includes a unit attaching hole 131*h*1, multiple sound holes 131*h*2, and a receiving portion 131*a*.

The unit attaching hole 131*h*1 holds the left driver unit 12. The unit attaching hole 131*h*1 has a shape of a circle. The unit attaching hole 131*h*1 is disposed in the center of the bottom portion 131.

The sound holes 131*h*2 establish communication between the left side and the right side of the left baffle plate 13. The multiple sound holes 131*h*2 are disposed around the unit attaching hole 131*h*1 of the bottom portion 131 at an equal interval.

The receiving portion 131*a* and the left unit fixing member 15 fix the left driver unit 12. The receiving portion 131*a* has a ring shape and disposed on the inner circumferential surface at the open end on the right side (the lower side in FIG. 5) of the unit attaching hole 131*h*1.

The left unit fixing member 15 is fixed to the bosses 134. The bosses 134 are integrally formed with the bottom portion 131 and protrude to the left side (the upper side in FIG. 5) from the bottom portion 131. The bosses 134 are disposed at three positions around the unit attaching hole 131*h*1 of the bottom portion 131 at an equal interval. The bosses 134 each include a screw hole 134*h*.

The number of the bosses is not limited to "three" in the present invention.

The left frame 14 holds the first left acoustic resistor R1. The left frame 14 is composed of synthetic resin, for example. The left frame 14 has a shape of an oval ring plate in the plain view. The left frame 14 includes multiple sound holes 14*h*.

The sound holes 14*h* establish communication between the left side and the right side of the left frame 14. The multiple sound holes 14*h* are disposed on the left frame 14 at an equal interval. The shapes and the positions of the sound holes 14*h* in the left frame 14 are the same as those of the sound holes 131*h*2 in the left baffle plate 13.

The left unit fixing member 15 fixes the left driver unit 12 to the left baffle plate 13. The left unit fixing member 15 is composed of metal having resilience, such as stainless steel. The left unit fixing member 15 has a shape of a ring plate in the plain view. The left unit fixing member 15 includes a contact portion 151, three fixing portions 152, and a unit insertion hole 15*h*.

The contact portion 151 fixes the left driver unit 12 to the left baffle plate 13, together with the receiving portion 131*a* of the left baffle plate 13. The contact portion 151 is has a shape of a circular ring plate (a frame) As shown in FIG. 3, the contact portion 151 has a thickness smaller than the depth of the depression 121*b*1 of the unit case 121.

The contact portion may have a thickness identical to the depth of the depression 121*b*1 of the unit case 121 in the present invention.

The unit insertion hole 15*h* is a hole which the body 121*a* of the unit case 121 of the left driver unit 12 is to be inserted in. The unit insertion hole 15*h* is disposed in the center of the contact portion 151 having a shape of a ring plate.

The fixing portions 152 fix the contact portion 151 to the left baffle plate 13. The fixing portions 152 are disposed at three positions adjacent to the outer edge of the contact portion 151 at an equal interval. The fixing portions 152 are integrally formed with the contact portion 151. The fixing portions 152 each have a wall portion 152*a*, an overhang portion 152*b*, and a fastening hole 152*h*. The wall portion 152*a* stands upright from the outer edge of the contact portion 151 toward the left side (the upper side in FIG. 5). The overhang portions 152*b* each overhang outwardly in the radial direction of the contact portion 151 from the left end of the corresponding walls 152*a*. The overhang portions 152*b* extend parallel to the contact portion 151. That is, the fixing portions 152 each have L-shapes in cross-sectional view (see FIG. 3).

The fastening holes 152*h* are holes which the fixing screws T are to be inserted in. The fastening holes 152*h* are each disposed in the center of the corresponding overhang portion 152*b* of the fixing portion 152.

The number of the fixing portions may be the same as that of the bosses of the left baffle plate, and is not limited to "three" in the present invention.

The left protector 16 protects the diaphragm 123 of the left driver unit 12 from a physical shock. The left protector 16 has a shape of a substantially disk shape. The center of the left protector 16 protrudes toward the right side (the lower side in FIG. 5). The left protector 16 includes multiple sound holes 16*h*.

Referring now back to FIG. 3, the left ear pad 17 is a buffer between the left baffle plate 13 and the head of a user. The left ear pad 1 has a shape of an oval ring in the plain view.

The first left housing 18 accommodates the left driver unit 12. The first left housing 18 has a shape of an oval bowl in the plain view. The first left housing 18 includes a bottom portion 181 and a protruding portion 182. The center of the bottom portion 181 protrudes toward the left side (the right side in FIG. 3), and the protruding portion 182 is thereby integrally formed with the bottom portion 181. The protruding portion 182 has a shape of a hollow cylinder with a closed end which is flat in the transverse direction (the transverse directions of FIG. 3).

The second left housing 19 accommodates the circuit board 11. The second left housing 19 has a shape of a hollow cylinder with a closed end in the plain view. The second left housing 19 includes two axial holes (not shown). The axial holes are respectively disposed in the front portion and the rear portion of the peripheral wall of the second left housing 19.

The first left acoustic resistor R1 and the second left acoustic resistor R2 control the frequency characteristics of the headphone 1, and serve as a damping material of the diaphragm 123. The first left acoustic resistor R1 and the second left acoustic resistor R2 are composed of felts or urethane foams, for example.

The fixing screws T fasten the left baffle plate 13 and the left unit fixing member 15. The fixing screws T are an example of a fastening member in the present invention.

The left hanger 20, the right sound emission unit 30, and the right hanger 40, the connection member 50, and the signal line will now be described with reference to FIG. 1.

The left hanger 20 supports the left sound emission unit 10. The left sound emission unit 10 supported by the left hanger 20 is swingable relative to the left hanger 20. The left hanger 20 is hollow, and has the lower portion in a reversed Y shape diverging in front and rear direction. The left hanger 20 includes two axial portions (not shown). The axial portions are coaxially disposed at the lower ends (at the tips of the diverged portions) of the left hanger 20.

The right sound emission unit 30 is worn around the right ear of the user and configured to output sound waves in response to sound signals from the sound source. The right sound emission unit 30 has the same structure as the left sound emission unit 10, except that the right sound emission unit 30 does not include the receiving circuit and the signal processing circuit. That is, the right sound emission unit 30 includes a right driver unit (not shown), a right baffle plate (not shown), a right frame (not shown), a right unit fixing member (not shown), a right protector 36, a right ear pad 37, a first right housing 38, a second right housing 39, a first right acoustic resistor (not shown), a second right acoustic resistor (not shown), and fixing screws (not shown).

The right hanger 40 supports the right sound emission unit 30. The right sound emission unit 30 supported by the right hanger 40 is swingable relative to the right hanger 40. The right hanger 40 has the same structure as the left hanger 20. That is, the right hanger 40 is hollow and includes a pair of axial portion (not shown).

The connection member 50 couples a pair of sound emission units (the left sound emission unit 10 and the right sound emission unit 30). The connection member 50 has a shape f an arch conforming to the form of the head of the user. The connection member 50 includes a left slide mechanism 51, a head band 52, and a right slide mechanism 53.

The left slide mechanism 1 slides along the longitudinal direction of the connection member 50, thereby changing the distance between the left sound emission unit 10 and the head band 52. The position of the left sound emission unit 10 is adjusted to the position of the left ear of the user by the movement of the left slide mechanism 51.

The head band 52 couples the left slide mechanism 51 and the right slide mechanism 53. The head band 52 is composed of synthetic resin having predetermined rigidity and resilience, or example. The head band 52 includes a resilient member (not shown). The resilient member is a plate spring, for example. The resilient member is disposed within the head band 52. The left sound emission unit 10 and the right sound emission unit 30 are biased so as to come close to each other, by the resilience of the resilient member.

The right slide mechanism 53 slides in the longitudinal direction of the connection member 50, thereby changing the distance between the right sound emission unit 30 and the head band 52. The position of the right sound emission unit 30 is adjusted to the position of the right ear of the user by the movement of the right slide mechanism 53.

The signal line transmits the processed signals from the signal processing circuit of the left sound emission unit 10 to the right driver unit of the right sound emission unit 30. The signal line is a "connection cord" wired between the left sound emission unit 10 and the right sound emission unit 30.

Assembly of Left Sound Emission Unit

The assembly of the left sound emission unit 10 will now be described with reference to FIGS. 3 to 5.

A left assembly L is first assembled with the left driver unit 12, the left baffle plate 13, the left frame 14, the left unit fixing member 15, the left protector 16, the first left acoustic resistor R1, and the fixing screws T.

The left driver unit 12 is fit into the unit attaching hole 131*h*1 of the left baffle plate 13. The flange portion 121*b* of the unit case 121 comes into contact with the receiving portion 131*a* of the left baffle plate 13.

The body 121*a* of the left driver unit 12 is inserted into the unit insertion hole 15*h* of the left unit fixing member 15 from the right side (the lower side in FIG. 5). In other words, the portion of the left driver unit 12 other than the outer edge (the flange portion 121*b*) is inserted into the unit insertion hole 15*h*. The contact portion 151 comes into contact with the depression 121*b*1 at the outer edge of the unit case 121. The overhang portions 152*b* of the fixing portions 152 are each overlaid onto the corresponding bosse 134 of the left baffle plate 13 from the left side (the upper side in FIG. 5). The fixing screws T are each inserted into the corresponding fastening hole 152*h* of the overhang portions 152*b*, and fit into the screw hole 134*h* of the bosse 134. That is, the fixing portions 152 are fixed to the left baffle plate 13 by the fixing screws T. As a result, the left driver unit 12 is held between the receiving portion 131*a* of the left baffle plate 13 and the contact portion 151 of the left unit fixing member 15. That is, the left driver unit 12 is fixed to the left baffle plate 13 by the left unit fixing member 15.

As described above, the left unit fixing member 15 is composed of metal having resilience, and has a shape of a plate. Thus, the left driver unit 12 is pressed toward the left baffle plate 13 through the resilience of the left unit fixing member 15. As a result, the unit fixing member according to the present invention fixes the driver unit (the left driver unit 12) to the baffle plate (the left baffle plate 13) more securely than the conventional fixing members composed of synthetic resin. In addition, even if the left driver unit 12 is vibrated, the vibration is restrained (absorbed) through the resilience of the left unit fixing member 15, since the left driver unit 12 is fixed with the resilient member (the left unit fixing member 15).

The first left acoustic resistor R1 is attached to the left frame 14. The left frame 14 is attached to the right side surface (the surface of the left side in FIG. 3) of the left baffle plate 13. The sound holes 14*h* of the left frame 14 overlie on the sound holes 131*h*2 of the left baffle plate 13. Thus, the left space in the left baffle plate 13 is brought into communication with the right space in the left frame 14 via the two sound holes 131*h*2, 14*h*.

The left protector 16 is attached to the flange portion 121*b* of the unit case 121.

Then, the left ear pad 17 is attached to the flange portion 133 of the left baffle plate 13. The left ear pad 17 covers the flange portion 133 of the left baffle plate 13 from the right side (the left side in FIG. 3).

Then, the first left housing 18 accommodating the second left acoustic resistor R2 is attached to the left baffle plate 13 from the left side (the right side in FIG. 3). The first left housing 18 covers the left driver unit 12 and the left unit fixing member 15 from the left side.

The first left housing 18 defines a first air chamber A1 together with the left driver unit 12, the left baffle plate 13, and the left unit fixing member 15. The first air chamber A1 is disposed on the left side of each of the left driver unit 12, the left baffle plate 13, and the left unit fixing member 15. As described above, the thickness of the contact portion 151 of the left unit fixing member 15 is smaller than the depth of the depression 121*b*1 of the unit case 121. Thus, the left unit fixing member 15 excluding the fixing portions 152 protrudes less toward the first air chamber A1 than the flange portion 121*b* of the unit case 121. That is, the left unit fixing member 15 does not define the space (the space having an acoustic capacitance) surrounded by the left unit fixing member 15 within the first air chamber A1. That is, the volume of the first air chamber A1 according to the present invention is larger than that of the first air chamber into which the fixing member for fixing the driver unit protrudes.

The second left acoustic resistor R2 is held between the bottom portion 181 of the first left housing 18 and the body 121*a* of the left driver unit 12. The second left acoustic resistor R2 comes in contact with the left driver unit 12. That is, a gap or space having an acoustic capacitance is not defined between the left driver unit 12 and the second left acoustic resistor R2, in the first air chamber A1.

Subsequently, the circuit board 11 is attached to the inner surface of the second left housing 19. The second left housing 19 is attached to the first left housing 18 from the left side. The second left housing 19 covers the protruding portion 182 of the first left housing 18 from the left side. The first left housing 18 and the second left housing 19 define a second air chamber A2. The second air chamber A2 is disposed on the left side of the first left housing 18.

Assembly of Headphone 1

The assembly of the headphone 1 will now be described with reference to FIG. 1.

The left hanger 20 is attached to the left sound emission unit 10 so as to span the peripheral wall of the upper half of the second left housing 19. The axial portions of the left hanger 20 are attached to the axial holes of the second left housing 19. The axial portions of the left hanger 20 attached to the axial holes are rotatable relative to the axial holes. As a result, the left sound emission nit 10 is swingable.

The right hanger 40 is attached to the right sound emission unit 30 in the same manner as the left hanger 20. As a result, the right sound emission unit 30 is swingable relative to the right hanger 40.

The connection member 50 is attached to the upper end portion of the left hanger 20 and to the upper end portion of the right hanger 40.

The signal line is connected to the signal processing circuit of the left sound emission unit 10 and to the right driver unit of the right sound emission unit 30. The signal line is disposed in the internal spaces of the second left housing 19 (the second air camber A2), the left hanger 20, the connection member 50, the right hanger 40, the second right housing 39, and the first right housing 38.

Operation of Headphone 1

The operation of the headphone 1 will now be described.

Figure 6:
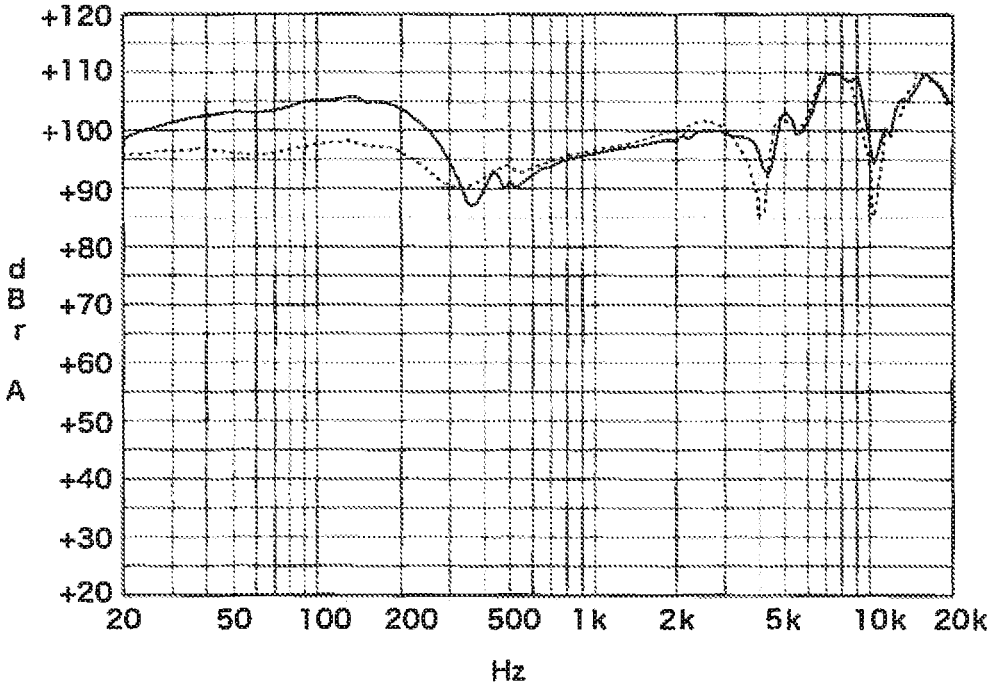
FIG. 6 is a graph showing the comparison of the frequency characteristics of the headphone according to the present invention with those of a conventional headphone.

FIG. 6 is a graph showing the comparison of the frequency response of the headphone according to the present invention with that of a conventional headphone.

FIG. 6 illustrates the frequency characteristics of the headphone according to the present invention with a solid line, and those of the conventional headphone with a dotted line, respectively. The driver unit of the conventional headphone is fixed to a baffle plate with a cylindrical fixing member which is composed of synthetic resin. The conventional headphone has the same structure as the headphone according to the present invention, except that the space (gap) having an acoustic capacitance is defined between the driver unit and the acoustic resistor and around the driver unit by the fixing member in the conventional headphone.

FIG. 6 indicates that the headphone of the present invention including the left driver unit 12 in contact with the second left acoustic resistor R2 in the first air chamber A1 exhibits a reduced resonance dip (drop in a waveform) in the range of 3 kHz to 20 kHz (a high frequency range). FIG. 6 also indicates that the headphone of the present invention including an enlarged volume of the first air chamber A1 exhibits an enhanced frequency response in the range of 300 Hz or lower (a low frequency range).

Summary

According to the embodiments described above, the left driver unit 12 is fixed to the left baffle plate 13 with the left unit fixing member 15 having a shape of a ring plate. The portion (body 121*a*) other than the flange portion 121*b* of the unit case 121 of the left driver unit 12 is inserted into the unit insertion hole 15*h* of the left driver unit 12. That is, the left unit fixing member 15 excluding the fixing portions 152 protrudes less toward the first air chamber A1 (the left side) than the flange portion 121*b* in the unit case 121. Thus, the second left acoustic resistor R2 is disposed in the first air chamber A1, and is in contact with the left driver unit 12. In other words, the space (gap) having an acoustic capacitance is not defined between the left driver unit 12 and the second left acoustic resistor R2. As a result, the headphone according to the present invention excels in the frequency characteristics in a high frequency range compared with conventional headphones that fix the driver unit with a cylindrical fixing member, for example.

In addition, according to the embodiments described above, the contact portion 151 of the left unit fixing member 15 is composed of metal having resilience. Thus, the left driver unit 12 is pressed toward the left baffle plate 13 through the resilience of the left unit fixing member 15. As a result, the unit fixing member according the present invention can fix the left driver unit 12 to the left baffle plate 13 more securely than conventional fixing members composed of synthetic resin. Even if the left driver unit 12 is vibrated, the vibration is restrained (absorbed) through the resilience of the left unit fixing member 15, since the left driver unit 12 is fixed with the resilient member (the left unit fixing member 15).

Furthermore, according to the embodiments described above, the left unit fixing member 15 does not define the space having an acoustic capacity within the first air chamber A1. Thus, the headphone according tea the present invention can enlarge the volume of an air chamber (the first air chamber) and enhance the frequency characteristics in a low frequency range, compared with conventional headphones.

In this manner, the headphone according to the present invention includes the driver unit fixed more securely to the baffle plate in a simpler structure than conventional headphones, and has desirable frequency characteristics in a high frequency range and a low frequency range.

In the embodiments described above, the left unit fixing member 15 is fastened to the bosses 134 disposed at an equal interval. Alternatively, the left unit fixing member may fit into an undercut provided on the inner circumferential surface (the surface forming the unit attaching hole) of the left baffle plate, for example. In this case, the left unit fixing member is partially fixed by the undercut. Thus, the number of the bosses can be reduced, and the volume of the first air chamber A1 can be enlarged.

In addition, the appearance (design) of the left unit fixing member for a headphone of an open type can be enhanced, by using different materials, such as aluminum and titanium, having different lusters for the left unit fixing member.

Furthermore, while the left and right driver units in the embodiments described above are configured to convert digital signals to sound waves, the left and right driver units may also be configured to convert sound signals (analog signals) to sound waves. In this case, a processing unit may convert sound signals received by a receiving unit from digital signals to analog signals (D/A conversion).

Furthermore, while the contact portion 151 is integrally formed with the fixing portions 152 in the embodiments described above, the contact may also be formed separately from the fixing portions.

The invention claimed is:

1. A headphone comprising:

a baffle plate;

a driver unit fixed to the baffle plate; and a fixing member fixing the driver unit to the baffle plate, wherein the driver unit comprises a unit case, the unit case comprises a flange portion and a body, the fixing member comprises a contact part in contact with the flange portion of the driver unit, the fixing member comprises an insertion hole, the body is inserted through the insertion hole past the fixing member such that the driver unit protrudes past the fixing member in a direction of insertion, and the driver unit is held between the baffle plate and the fixing member.

2. The headphone according to claim 1, wherein the contact part has resilience.

3. The headphone according to claim 1, wherein the fixing member comprises at least one fixing portion fixed to the baffle plate, the contact part has an outer edge, and the at least one fixing portion is disposed adjacent to the outer edge of the contact part.

4. The headphone according to claim 1, wherein the contact part has a shape of a ring.

5. The headphone according to claim 3, wherein the at least one fixing portion each comprises a fastening hole in which a fastening member fastening the fixing member and the baffle plate are to be inserted.

6. The headphone according to claim 5, wherein the baffle plate comprises at least one boss to which the fixing member is fixed, the at least one boss each has a hole, and the fastening member inserted into the fastening hole is fit into the hole of the boss.

7. The headphone according to claim 6, wherein the at least one fixing portion each comprises an overhang portion in which the fastening hole is disposed.

8. The headphone according to claim 7, wherein the at least one fixing portion each comprises a wall portion standing from the outer edge of the contact part, and the overhang portion overhangs from the wall portion.

9. The headphone according to claim 8, wherein the overhang portion extends in parallel to the contact part.

10. The headphone according to claim 3, wherein the at least one fixing portion is integrally formed with the contact part.

11. The headphone according to claim 1, wherein the flange portion comprises a depression, and the contact part is in contact with the depression.

12. The headphone according to claim 11, wherein the contact part has a thickness smaller than or equal to the depth of the depression.

13. The headphone according to claim 1 wherein the flange portion has a shape of a ring, wherein the body of the unit case has a shape of a hollow cylinder with an open end and a closed end, and wherein the flange portion of the unit case is disposed on an outer circumferential surface of the open end of the body.

14. The headphone according to claim 13, wherein the flange portion is held between the baffle plate and the contact part.

* * * * *